US011649930B2

(12) United States Patent
Hivert et al.

(10) Patent No.: US 11,649,930 B2
(45) Date of Patent: May 16, 2023

(54) FLUID-STORAGE FACILITY

(71) Applicant: Gaztransport Et Technigaz, Saint Remy les Chevreuse (FR)

(72) Inventors: Emmanuel Hivert, Saint Remy les Chevreuse (FR); Christophe Leconte, Saint Remy les Chevreuse (FR); Pierre Charbonnier, Saint Remy les Chevreuse (FR); Mohammed Oulalite, Saint Remy les Chevreuse (FR); Jean-Damien Capdeville, Saint Remy les Chevreuse (FR); Geoffrey Detaille, Saint Remy les Chevreuse (FR)

(73) Assignee: Gaztransport Et Technigaz, Saint Remy les Chevreuse (FR)

( * ) Notice: Subject to any disclaimer, the term of this patent is extended or adjusted under 35 U.S.C. 154(b) by 0 days.

(21) Appl. No.: 17/260,989

(22) PCT Filed: Jul. 12, 2019

(86) PCT No.: PCT/FR2019/051758
§ 371 (c)(1),
(2) Date: Jan. 15, 2021

(87) PCT Pub. No.: WO2020/016509
PCT Pub. Date: Jan. 23, 2020

(65) Prior Publication Data

US 2021/0293384 A1 Sep. 23, 2021

(30) Foreign Application Priority Data

Jul. 16, 2018 (FR) ..... 1856563

(51) Int. Cl.
*F17C 13/00* (2006.01)
*B63B 27/25* (2006.01)

(52) U.S. Cl.
CPC ..... *F17C 13/004* (2013.01); *B63B 27/25* (2013.01); *F17C 2201/0104* (2013.01);
(Continued)

(58) Field of Classification Search
CPC ..... B63B 27/25; F17C 13/004; F17C 2201/0104; F17C 2201/0128;
(Continued)

(56) References Cited

U.S. PATENT DOCUMENTS 4,170,952 A * 10/1979 McCown ..... F17C 13/001 220/560.08
5,870,871 A * 2/1999 Stewart ..... E02D 29/125 52/514

(Continued)

FOREIGN PATENT DOCUMENTS

JP 06272466 A 9/1994
JP 2000168885 6/2000

(Continued)

OTHER PUBLICATIONS

Office Action issued in corresponding JP Application No. 2021-502608 dated Sep. 6, 2022.

*Primary Examiner* — Nicolas A Arnett
(74) *Attorney, Agent, or Firm* — Blank Rome LLP

(57) ABSTRACT

The invention relates to a fluid storage facility, the storage facility comprising a supporting structure (1) and a tank, the tank having at least one tank bottom wall fixed to the supporting structure (1), wherein the bottom wall has a structure with multiple layers superimposed in a direction of thickness, including at least one sealing membrane and at least one thermal insulation barrier arranged between the sealing membrane and the supporting structure (1),
wherein the bottom wall has a sump structure (9) having a rigid container (10, 11) comprising a side wall (12), the
(Continued)

container (10, 11) being arranged through the thickness of the bottom wall, and the sump structure (9) comprising at least one fixing means (15) designed to fix the rigid container (11) to the supporting structure (1) at a fixing point, and wherein the at least one fixing means (15) is configured to allow the relative movement of the side wall (12) of the container (11) with respect to the supporting structure (1) in a transverse direction perpendicular to the side wall (12) at the fixing point of the container (11).

32 Claims, 5 Drawing Sheets

(52) U.S. Cl.
CPC ..... *F17C 2201/0128* (2013.01); *F17C 2201/052* (2013.01); *F17C 2203/0358* (2013.01); *F17C 2203/0643* (2013.01); *F17C 2203/0646* (2013.01); *F17C 2203/0651* (2013.01); *F17C 2205/0355* (2013.01); *F17C 2221/033* (2013.01); *F17C 2223/0153* (2013.01); *F17C 2227/0135* (2013.01); *F17C 2227/0178* (2013.01); *F17C 2270/0107* (2013.01)

(58) Field of Classification Search
CPC ..... F17C 2201/052; F17C 2203/0358; F17C 2203/0643; F17C 2203/0646; F17C 2203/0651; F17C 2205/0355; F17C 2221/033; F17C 2223/0153; F17C 2227/0135; F17C 2227/0178; F17C 2270/0107; F16B 5/02–0291
See application file for complete search history.

(56) References Cited

U.S. PATENT DOCUMENTS

| | | | | |
|---|---|---|---|---|
| 6,036,422 | A * | 3/2000 | Postma | F16B 5/0241 411/537 |
| 7,153,054 | B2 * | 12/2006 | Arbona | F16B 37/045 403/30 |
| 9,422,956 | B2 * | 8/2016 | Hayton | F16B 5/0607 |
| 2013/0287520 | A1 * | 10/2013 | Hartzler | F16B 5/0241 411/347 |
| 2014/0124086 | A1 * | 5/2014 | Jean | B65D 90/06 141/1 |

FOREIGN PATENT DOCUMENTS

| | | |
|---|---|---|
| KR | 20160119343 | 10/2016 |
| WO | WO 2016001142 | 1/2016 |

* cited by examiner

FLUID-STORAGE FACILITY

This application is a national phase application of PCT/FR2019/051758, filed Jul. 12, 2019 which claims priority to French Application No. 1856563 filed Jul. 16, 2018. The entire contents of those applications are incorporated herein by reference.

TECHNICAL FIELD

The invention relates to the field of fluid storage facilities comprising a sealed and thermally insulating tank with a membrane. In particular, the invention relates especially to facilities for the storage and/or transport of liquefied gas at low temperature, such as liquefied petroleum gas (also called LPG) having, for example, a temperature of between −50° C. and 0° C., or liquefied natural gas (LNG) at around −162° C. at atmospheric pressure. These facilities can be set up on land or on an offshore structure. In the case of an offshore structure, the tank of the storage facility can be intended to transport liquefied gas or to receive liquefied gas serving as fuel for the propulsion of the offshore structure.

TECHNOLOGICAL BACKGROUND

Fluid storage facilities are known, for example, from the document WO2016/001142. Such a storage facility comprises a supporting structure, for example the inner hull of a ship, and a sealed and thermally insulating tank situated inside the supporting structure and fixed thereto. The sealed and thermally insulating tank has a structure of multiple layers superimposed in a direction of thickness and comprising a sealing membrane and a thermally insulating barrier arranged between the sealing membrane and the supporting structure.

In order to maximize the operational yield of such a tank, it is desirable to optimize the useful volume of cargo that it is possible to load into the tank and offload from the tank. The use of an offloading pump sucking the liquid toward the top of the tank means that a certain height of liquid has to be kept at the bottom of the tank, failing which the suction member of the pump comes into communication with the gaseous phase, which drains and/or damages the pump. This is why it is known to form a sump structure on the bottom wall of such a tank, locally interrupting the sealing membrane, the sump structure comprising a container engaged through the bottom wall of the tank in such a way that the liquid in the container is at the lowest level of the tank.

The offloading pump is therefore placed in such a sump structure, which makes it possible to maximize the operational yield of the tank.

However, during the loading of the tank with a cryogenic fluid such as LNG, those elements of the tank directly in contact with the fluid, such as the sump structure, are subject to a strong temperature variation, which has the effect of contracting them thermally. However, the sump structure is fixed to the supporting structure, which is not in contact with the cryogenic fluid. The fixing means making it possible to fix the sump structure to the supporting structure could therefore be subjected to considerable mechanical stresses, which can accelerate the fatigue experienced by the materials and can limit the operational life of the tank.

It is also known, in particular from the document JP2000168885, to use a sump structure in onshore storage facilities of the underground type, of which the supporting structure is made of concrete. In this type of facility; the sump structure is not fixed to the supporting structure but simply placed on the supporting structure. The reason is that, in this type of facility, no movement of fluid is expected, in contrast to storage in offshore structures, and it is therefore possible not to fix the sump structure. However, this design is not compatible with ail uses.

Furthermore, mechanical stresses associated with this application, consisting in the formation of a sump in the sealed and thermally insulating tank, must be taken into account by a person skilled in the art.

SUMMARY

One concept on which the invention is based is to improve the fixing between the sump structure and the supporting structure in order to increase its service life and its reliability.

According to one embodiment, the invention makes available a fluid storage facility, the storage facility comprising a supporting structure and a sealed and thermally insulating tank; the tank having at least one bottom wall fixed to the supporting structure, wherein the bottom wall has a structure with multiple layers superimposed in a direction of thickness, including at least one sealing membrane and at least one thermal insulation barrier arranged between the sealing membrane and the supporting structure, wherein the bottom wall has a sump structure locally interrupting the sealing membrane of the bottom wall, the sump structure having a rigid container having a side wall, the container being arranged through the thickness of the bottom wall, and the sump structure comprising at least one fixing means designed to fix the rigid container to the supporting structure at a fixing point of the side wall, and wherein the at least one fixing means is configured to allow a relative movement of the side wall of the container with respect to the supporting structure in a transverse direction perpendicular to the side wall at the fixing point of the container, the relative movement being greater than 1 mm, for example between 1 and 5 mm.

The expression "in a transverse direction perpendicular to the side wall at the fixing point" means the direction orthogonal to the tangent plane of the side wall at the fixing point.

Moreover, the expression "fixing point of the side wall" refers, according to all the embodiments, to the site where the fixing means is fixed to the sump structure, at the level of the side wall of the latter.

Thus, the at least one fixing means makes it possible to fix the sump structure to the supporting structure while allowing the side wall of the container of the sump structure to execute a relative movement with respect to the supporting structure in the transverse direction. The sump structure can thus contract thermally while remaining fixed to the supporting structure and preventing the at least one fixing means from being subjected to excessive mechanical stresses.

According to the embodiments, such a storage facility can have one or more of the following features.

According to one embodiment, the at least one fixing means comprises a first portion fixed, preferably welded, to the supporting structure, and a second portion fixed, preferably welded, to the side wall of the container.

According to one embodiment, the at least one fixing means is fixed directly, preferably welded directly, to the supporting structure.

According to one embodiment, the at least one fixing means is fixed directly, preferably welded directly, to the side wall of the container.

According to one embodiment, the supporting structure is made of a metallic material.

According to one embodiment, the supporting structure is a portion of the hull of an offshore structure.

According to one embodiment, the at least one fixing means is situated between the sealing membrane and the supporting structure in the direction of thickness.

According to one embodiment, the sump structure comprises a fixing wing fixed in a sealed manner, that is to say forming a closed surface not allowing the fluid to pass, for example welded, to the sealing membrane.

According to one embodiment, the at least one fixing means is at least partially situated under the fixing wing in the direction of thickness.

According to one embodiment, the sealing membrane is a secondary sealing membrane, the thermally insulating barrier is a secondary thermally insulating barrier, the fixing wing is a second fixing wing, wherein the bottom wall comprises a primary thermally insulating barrier situated on the secondary sealing membrane and also comprises a primary sealing membrane situated on the primary thermally insulating barrier, and wherein the sump structure comprises a first fixing wing fixed in a sealed manner, this is that is to say forming a closed surface not allowing the fluid to pass, for example welded, to the primary sealing membrane.

According to one embodiment, the container is a second container, the sump structure comprises a first container, a lower part of which is situated in the second container, the first fixing wing being an extension of the first container, and the second fixing wing being an extension of the second container, and wherein the at least one fixing means is situated on the side wall of the second container.

According to one embodiment, the side wall has a cylindrical shape with an axis oriented in the direction of thickness.

The cylindrical side wall can have different shapes in cross section.

According to one embodiment, the rigid container has a circular cross section, the transverse direction being a radial direction.

According to one embodiment of the invention, set out below in connection with the accompanying FIGS. 1 to 5, the facility comprises at least one blocking means configured to block the movement of the at least one fixing means in the direction of thickness and in a tangential direction, the tangential direction being tangential to the side wall and orthogonal to the transverse direction and to the direction of thickness.

According to one embodiment, the at least one fixing means has a fixing lug projecting from the rigid container in the transverse direction, the fixing lug having an orifice, and wherein the facility comprises an anchoring device arranged in the orifice in order to fix the fixing lug to the supporting structure in the direction of thickness.

By virtue of these features, the anchoring device makes it possible to prevent the movement of the sump structure in the direction of thickness with respect to the supporting structure.

According to one embodiment, the blocking means comprises the anchoring device.

According to one embodiment, the facility comprises two stops fixed to the supporting structure and situated on either side of the at least one fixing lug in a tangential direction, the tangential direction being tangential to the side wall and orthogonal to the transverse direction and to the direction of thickness, the stops being configured to block the movement of the fixing lug in the tangential direction.

By virtue of these features, the stops make it possible to prevent the movement of the sump structure in the tangential direction with respect to the supporting structure.

According to one embodiment, the blocking means is formed by the combination of the stops and of the anchoring device.

According to one embodiment, the orifice has an oblong orifice, the largest dimension of which is oriented in the transverse direction in such a way as to allow the transverse movement of the fixing lug and of the side wall with respect to the anchoring device and to the supporting structure.

According to one embodiment, the orifice has a circular orifice having a diameter greater than a diameter of the anchoring device, so as to allow the transverse movement of the fixing lug and of the side wall with respect to the anchoring device and to the supporting structure.

By virtue of these features, the large dimension of the oblong hole or the diameter of the circular orifice allows the fixing lug to move in the transverse direction with respect to the anchoring device. Thus, the side wall of the sump structure can move with respect to the supporting structure in the transverse direction, which has the effect of allowing the thermal contraction of the sump structure.

According to one embodiment, the facility comprises two perforated plates comprising a perforation, the perforated plates being situated on either side of the at least one fixing lug in the direction of thickness, and the anchoring device passing through the perforation of each perforated plate, the perforated plates being made of a material whose coefficient of friction is less than 0.2, preferably between 0.05 and 0.2.

By virtue of these features, the perforated plates make it possible to clamp the fixing lug between the anchoring device and the supporting structure in the direction of thickness, while allowing the movement of the fixing lug with respect to the supporting structure in the transverse direction. Indeed, the low coefficient of friction of the perforated plates makes it possible to minimize the frictional force between the fixing lug and the supporting structure, which has the effect of avoiding damage to the fixing lug and of facilitating the contraction of the sump structure.

According to one embodiment, the perforation of the perforated plate extends from one edge of the plate toward the center of the plate in the transverse direction, so as to permit transverse positioning of the plate.

According to one embodiment, the perforated plates are made of polytetrafluoroethylene (PTFE) or high-density polyethylene (HDPE).

According to one embodiment, the stops and/or the shims are made of metal, for example of stainless steel.

According to one embodiment, the sealing membrane, one of the sealing membranes or the sealing membranes are made of a metal from stainless steel, aluminum, Invar®: that is to say an alloy of iron and of nickel, the coefficient of expansion of which is typically comprised between $1.2.10^{-6}$ and $2.10^{-6}$ $K^{-1}$, or an alloy of iron with a high manganese content whose coefficient of expansion is of the order of $7.10^{-6}$ $K^{-1}$.

According to one embodiment, the fixing lug, the reinforcing bracket, and the container or containers are made of metal, for example of the same metal as the sealing membrane to which they are fixed.

According to one embodiment, the anchoring device has a threaded rod or a stud and a nut, the threaded rod being fixed to the supporting structure and, according to one embodiment, the threaded rod passes through the perforations of the perforated plates and the orifice of the fixing lug, the nut being configured to exert a clamping force in the direction of thickness on the perforated plates and the fixing lug with the aid of the supporting structure.

According to one embodiment, the nut is welded in the clamping position on the threaded rod so as to ensure that the nut does not accidentally unscrew during use. It will be possible for the nut to be fixed by any other suitable blocking means.

According to one embodiment, the facility comprises one or more shims arranged between the stops and the fixing lug in the tangential direction, the shims being configured to adjust the distance left free between a stop and a fixing lug in the tangential direction.

By virtue of these features, the fixing of the sump structure is adjustable, so as to take account of positioning tolerances.

According to one embodiment, the facility has at least one slide fixed to the supporting structure and oriented in the transverse direction, and the at least one fixing means is a fixing lug projecting from the rigid container in the transverse direction, the fixing lug being mounted in the slide, and the fixing lug being movable in the slide in the transverse direction in order to obtain said relative movement.

By virtue of these features, the slide allows the side wall to move in the transverse direction, so as to avoid subjecting the fixation to strong stresses during thermal contraction.

According to one embodiment, the slide has a first portion projecting from the supporting structure in the direction of thickness, and a second portion connected to the first portion and oriented in the tangential direction, so as to form a slide with an L-shaped cross section.

By virtue of these features, the shape of the slide makes it possible to block the movement of the fixing lug and therefore of the sump structure in the direction of thickness and at least partly in the tangential direction.

According to one embodiment, the blocking means comprises the slide.

According to one embodiment, the facility has two slides situated on either side of the at least one fixing lug in the tangential direction, the slides being configured to block the movement of the fixing lug in the direction of thickness and in the tangential direction.

By virtue of these features, the slides make it possible to block the movement of the fixing lug and therefore of the sump structure in the direction of thickness and in the tangential direction.

According to one embodiment, the blocking means is formed of the two slides situated on either side of the fixing lug.

According to one embodiment, the sump structure comprises at least one reinforcing bracket, a first side of the reinforcing bracket being fixed on the fixing lug, and a second side of the reinforcing bracket, perpendicular to the first side, being fixed to the rigid container.

By virtue of these features, the fixing lug is reinforced by the reinforcing bracket, in particular in terms of bending in the thickness direction, so as to prevent the fixing lug from being damaged during the use of the facility.

According to one embodiment, the fixing lug comprises two reinforcing brackets, the first side of the brackets being fixed on an upper surface or on a lower surface of the fixing lug, the brackets being placed on either side of the orifice of the fixing lug.

According to one embodiment, the sump structure comprises a plurality of fixing means distributed regularly or irregularly on the circumference of the container, for example three or four fixing means.

By virtue of these features, the sump structure is fixed around its entire circumference, preventing it from moving as a whole, while leaving the side wall free to contract or expand. This fixing can be realized in a more or less uniform manner.

According to one embodiment, the at least one fixing means is an elastically deformable fastener having a first end welded to the supporting structure, and a second end welded to the sump structure.

By virtue of these features, the fastener can deform elastically and thus allow contraction of the sump structure while keeping the latter fixed to the supporting structure.

According to one embodiment, the fastener is formed continuously around the sump structure.

By virtue of these features, the fastener is formed in a single piece, fixing the sump structure to the supporting structure in a uniform manner all around its circumference.

According to one embodiment, the fastener is open-worked with slits arranged all around the sump structure.

According to one embodiment, the facility comprises a plurality of elastically deformable fasteners distributed regularly or irregularly all around the sump structure.

By virtue of these features, the fasteners make it possible to fix the sump structure to the supporting structure uniformly all around its circumference. The fasteners, distributed non-periodically around the perimeter of the sump structure, advantageously permit optimized fixing.

According to one embodiment, the cross section of the fastener in a normal vector plane oriented in the tangential direction is straight or curved. Of course, the fasteners can have different cross-sectional shapes.

According to one embodiment, the cross section of the fastener is curved and comprises a curvature of constant sign, the curvature having a small or a large variation in curvature.

According to one embodiment, the cross section of the fastener is curved and comprises a plurality of curvatures with a variation of the sign of curvature, for example so as to form at least one undulation.

According to one embodiment, the cross section of the fastener comprises a bearing point on the supporting structure between the first end of the fastener and the second end of the fastener.

Such a facility may be an onshore storage facility, for example for storing LNG, or it may be set up in an offshore, inshore or deep-water structure, notably a LNG tanker, a floating storage regasification unit (FSRU), a floating production, storage and offloading (FPSO) unit and the like. Such a tank can also serve as a fuel tank in any type of ship.

According to one embodiment, a ship for transporting a cold liquid product has an outer hull and an aforementioned fluid storage facility arranged in the outer hull, wherein the supporting structure is an inner hull of the ship.

According to one embodiment, the invention also makes available a method of loading or offloading such a ship, wherein a cold liquid product is conveyed through insulated pipes from or to an offshore or onshore storage facility to or from the tank of the ship.

According to one embodiment, the invention, also makes available a transfer system for a cold liquid product, the system comprising the aforementioned ship, insulated pipes arranged in such a way as to connect the tank, set up in the hull of the ship, to an offshore or onshore storage facility, and a pump for driving a flow of cold liquid product through the insulated pipes from or to the offshore or onshore storage facility to or from the tank of the ship.

BRIEF DESCRIPTION OF THE FIGURES

The invention will be better understood, and other objects, details, features and advantages thereof will appear more clearly, from the following description of several particular embodiments of the invention, which are given solely by way of illustration and without limitation, with reference to the accompanying drawings.

DETAILED DESCRIPTION OF EMBODIMENTS

Figure 1:
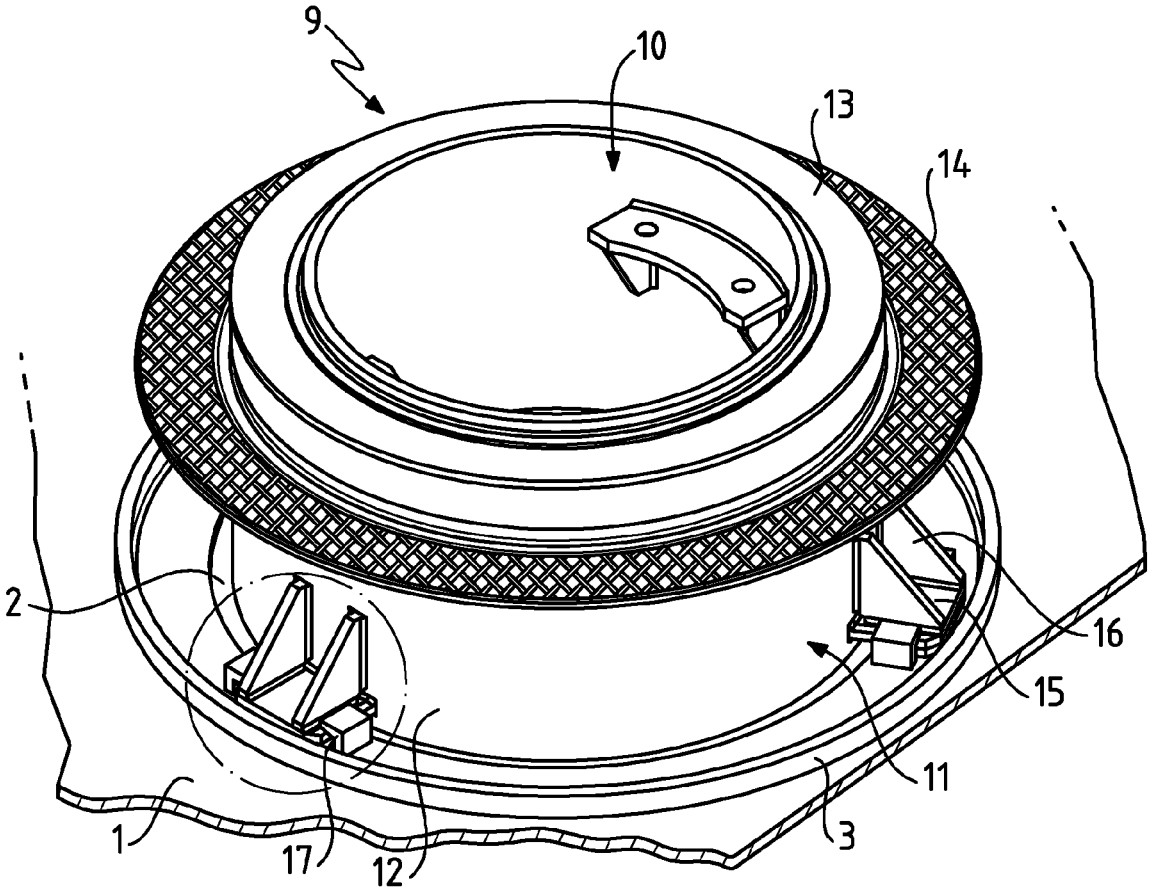
FIG. 1 shows a perspective view of a sump structure fixed to a supporting structure according to a first embodiment.

In the description below, a storage facility 71 will be described which comprises a supporting structure 1, a sealed and thermally insulating tank, and a sump structure 9 that can be used in the bottom wall 4 of a storage tank and/or transport tank for LNG. The bottom wall 4 denotes a wall 4, preferably generally planar, situated at the bottom of the tank with respect to the earth's gravitational field. The general geometry of the tank can also be of different types. Polyhedral geometries are the most common, A cylindrical, spherical or other type of geometry is also possible.

The walls 4 of the tank are formed by a multilayer structure fixed to load-bearing walls 1 and including two sealed membranes 5, 7 alternating with two thermally insulating barriers 6, 8. Since there are many known techniques for producing these multilayer structures, the description below will be limited to the sump structure 9 and to the fixing of the latter to the supporting structure 1 of the storage facility 71.

The tank wall 4 is mounted on a supporting structure 1, made for example of thick sheet steel, such as the inner hull of a double-hulled ship 70. The tank wall 4 has a multilayer structure including, successively, a secondary thermal insulation barrier 8 fixed to the supporting structure 1, for example by means of beads of mastic, a secondary sealing membrane 7 supported by the secondary thermal insulation barrier 8, a primary thermal insulation barrier 6 covering the secondary sealing membrane 7, and a primary sealing membrane 5 supported by the primary thermal insulation barrier 6.

FIG. 1 shows a sump structure 9 fixed to a supporting structure 1 according to a first embodiment.

At the location of the sump structure 9, the supporting structure has an opening 2, illustrated in FIG. 1 as being of circular shape, through which the sump structure 9 is engaged and which allows the sump structure 9 to protrude outside the supporting structure 1 in the direction of thickness of the tank wall 4.

A rigid cylindrical container 10, 11 is fixed to the supporting structure 1 with the aid of one or more fixing means 15, 32 around the opening 2 and projects outward from the supporting structure 1 to form an extension structure which provides an additional space for housing the sump structure 9. More specifically, the container 10, 11 has a cylindrical side wall 12, for example circular or otherwise. The container 10, 11 can be made of materials similar to the supporting structure 1 or to one of the sealing membranes 5, 7.

The sump structure 9 has a first container 10, in communication with the interior of the tank, and a second container 11, surrounding the lower part of the first container 10. The first container 10 is connected continuously to the primary sealing membrane 5, which it thus completes in a leaktight manner. Likewise, the second container 11 is connected continuously to the secondary sealing membrane 7, which it thus completes in a leaktight manner.

More specifically, the first container 11 has a cylindrical side wall 12 whose axis is perpendicular to the supporting structure 1 and which has a first fixing wing situated on an upper part of the side wall and substantially aligned with the primary sealing membrane 5 and a lower part engaged in the opening 2 below the supporting structure. A bottom wall parallel to the supporting structure 1 closes the cylindrical side wall at its lower part. The first fixing wing is fixed at the edge of the upper part of the cylindrical side wall and projects radially outside thereof all around the first container 10.

Figure 6:
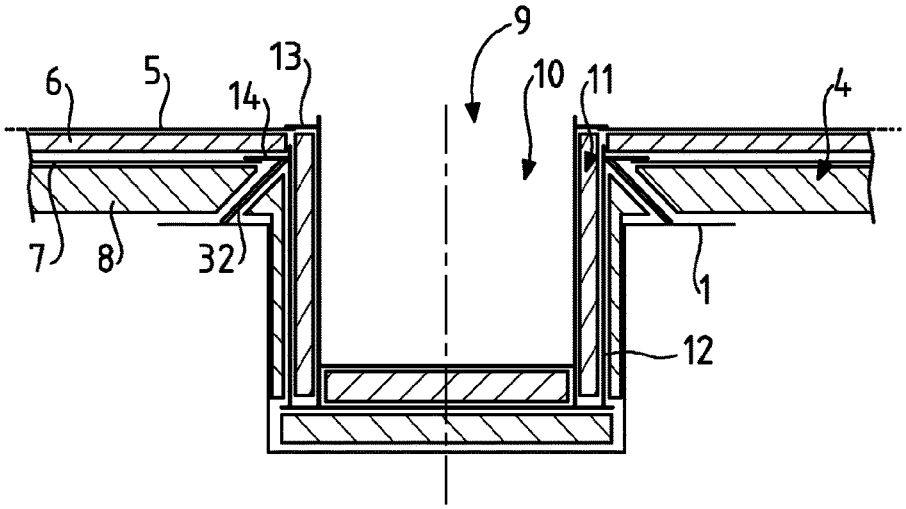
FIG. 6 shows a schematic sectional view of a sump structure fixed to a supporting structure according to a third embodiment.

The primary sealing membrane 5 thus has an interruption in the form of a window, for example a circular or square window, the edge of which surrounds the sump structure 9 and is connected in a sealed manner to the first fixing wing 13, for example by welding or adhesive bonding, as can be seen from FIG. 6.

Similarly, the second container 11 has a cylindrical side wall 12 whose axis is perpendicular to the supporting structure 1 and which has a second fixing wing 14 substantially aligned with the secondary sealing membrane 7 and a lower part engaged in the opening below the bottom wall of the first container 10. A bottom wall parallel to the supporting structure closes the cylindrical side wall 12 of the second container 11 at the lower part thereof. The cylindrical side wall 12 of the second container 11 surrounds the cylindrical side wall of the first container 10 at a distance therefrom. The second fixing wing 14 is fixed at the edge of the upper part of the cylindrical side wall 12 and projects radially outside thereof all around the second container 11.

The secondary sealing membrane 7 also has an interruption in the form of a window, for example a circular or square window, the edge of which surrounds the sump structure 9 and is connected in a sealed manner to the second fixing wing 14, for example by welding or adhesive bonding, as can be seen from FIG. 6.

In the tank wall 4, the space between the supporting structure 1 and the secondary sealing membrane 7 is a secondary space which contains the secondary thermally insulating barrier 8 and in which it is possible to circulate a flow of nitrogen as a safety measure. In the sump structure 9, the space between the second container 11 and the supporting structure 1 is also a secondary space, which communicates with the secondary space of the tank wall 4 in order to be able to receive this sweep of nitrogen.

The secondary thermally insulating barrier 8 is formed, for example, from modular blocks which are juxtaposed in order to line the supporting structure 1 relatively uniformly. These modular blocks stop at a certain distance from the sump structure 9, as can be seen from FIG. 6. Insulating blocks of suitable shape can be designed to approach quite close to the sump structure 9 or to fit into the latter and thus limit the gap remaining to be filled in the secondary insulation. Insulating materials are housed in the gap between the edge of the secondary thermally insulating barrier 8 and the second container, and also in the secondary space of the sump structure 9 in order to complete the thermal insulation around the second container 11. In fact, the secondary sealing membrane 7 and the second container 11 are liable to be in contact with the cryogenic fluid in the event of an accidental leak in the primary sealing membrane 5.

Similarly, in the tank wall 4, the space between the secondary sealing membrane 7 and the primary sealing membrane 5 is a primary space which contains the primary thermally insulating barrier 6 and in which it is possible to circulate a nitrogen flow as a safety measure. In the sump structure 9, the space between the first container 10 and the second container 11 is also a primary space, which communicates with the primary space of the tank wall 4 in order to be able to receive this sweep of nitrogen.

The primary thermally insulating barrier 6 is formed, for example, of modular blocks which are juxtaposed in order to line the secondary sealing membrane 7 relatively uniformly. These modular blocks stop at a certain distance from the sump structure 9. Insulating blocks of suitable shape can be designed to approach quite close to the sump structure 9 or to fit into the latter and thus limit the gap remaining to be filled in the primary insulation. Insulating materials are housed in the gap between the edge of the primary insulating barrier 6 and the first container 10, and also in the primary space of the sump structure 9 in order to complete the thermal insulation around the first container 10. In fact, the primary membrane 5 and the first container 10 are in contact with the LNG during use.

Different insulating materials may be suitable for completing the primary and secondary thermal insulation, for example glass wool or rock wool, polymer foams, in particular polyurethane or PVC, balsa wood, plywood, aerogels, and others.

In service, because of its position below the primary sealing membrane 5, the first container 10 receives by gravity any liquid residue present in the tank, in the manner of a sump. The first container 10 has sufficient capacity to keep the suction head of the pump immersed in the liquid and thus maximizes the operational yield of the tank.

To have good structural stability, the first container 10 and the second container 11 are made of a more rigid material than the sealing membranes, for example sheet metal with a thickness of the order of 6 to 20 mm.

Other embodiments of a sump structure 9 are described in the document WO2016/001142, for example.

Figure 2:
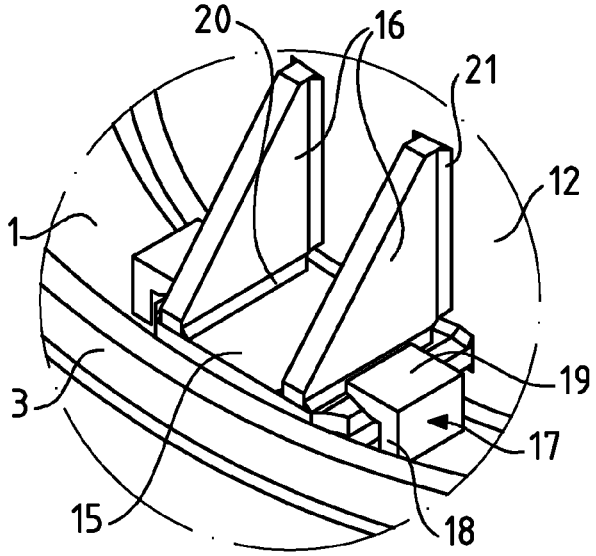
FIG. 2 is a detail view of FIG. 1.

In the first embodiment illustrated in FIGS. 1 and 2, the sump structure comprises, on the cylindrical side wall 12 of the second container 11, fixing means 15 in the form of fixing lugs 15. The fixing lugs 15 allow the sump structure 9 to be fixed to the supporting structure 1.

The fixing lugs 15 protrude from the second container 11 in the radial direction and are distributed regularly all around the side wall 12, for example as is illustrated in FIG. 1 the fixing lugs 15 are three in number and are situated at 120° from each other.

In order to stiffen each fixing lug 15, the sump structure 9 comprises two reinforcing brackets 16 on each fixing lug 15. The reinforcing brackets 16 have a first side 20, fixed on an upper surface of a fixing lug 15, and a second side 21, perpendicular to the first side 20 fixed to the side wall 12 of the second container 11.

The supporting structure 1 comprises slides 17 near the opening 2. The slides 17 are formed by a first portion 18 projecting from the supporting structure 1 in the direction of thickness, and by a second portion 19 connected to the first portion 18 directed in the tangential direction so as to form slides having an L-shaped cross section. As is illustrated in FIGS. 1 and 2, each fixing lug 15 is sandwiched between two slides 17 in such a way that a part of the second portion 19 of each slide 17 is placed above the fixing lug in the direction of thickness. Thus placed, the slides 17 make it possible to block the movement of the fixing lugs 15 and therefore of the sump structure in the direction of thickness and in the tangential direction.

In addition, the slides 17 allow each fixing lug 15 to retain a degree of freedom, namely in translation in the radial direction so as to allow the contraction or thermal expansion of the sump structure 9.

Figure 3:
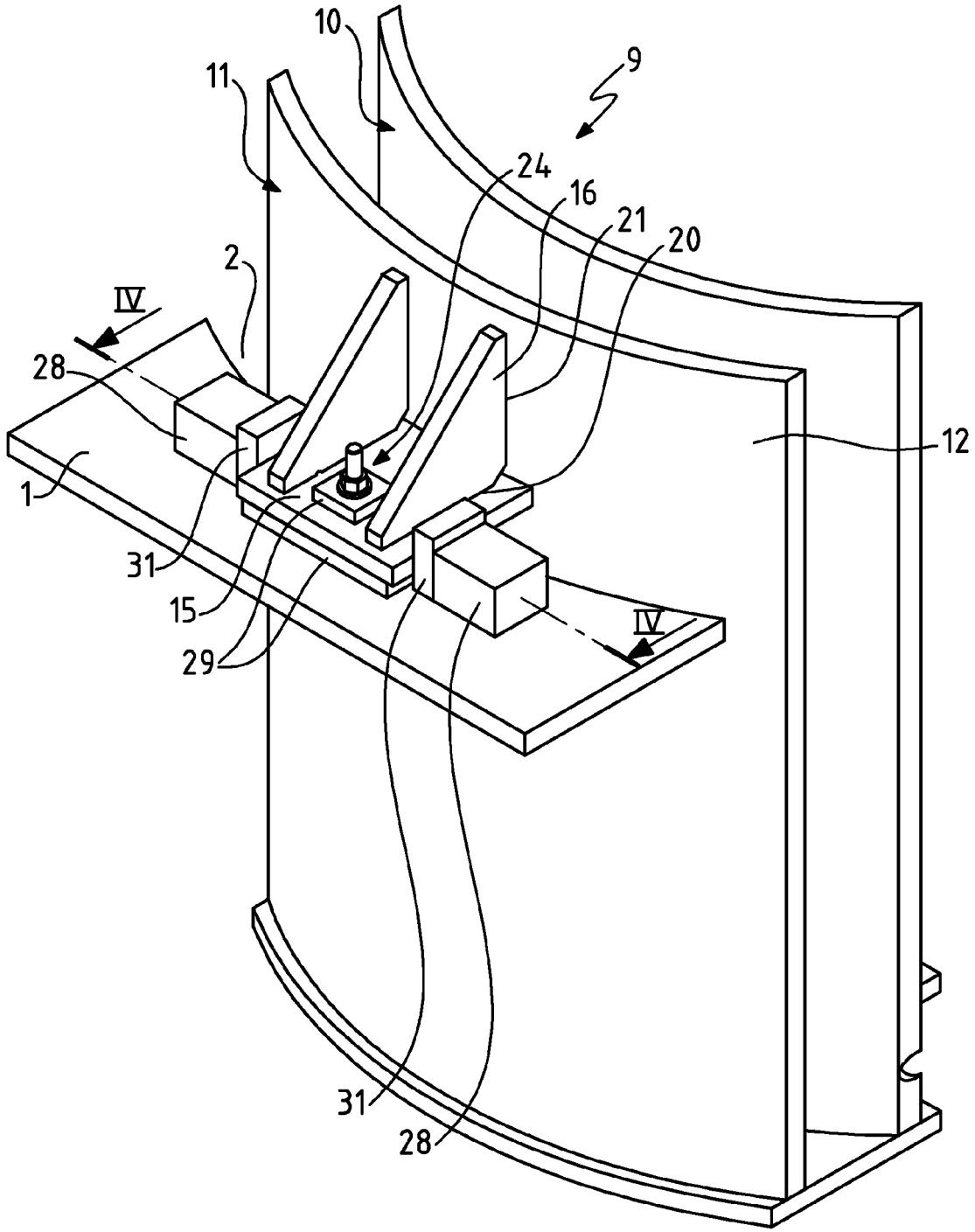
FIG. 3 shows a partial perspective view of a sump structure fixed to a supporting structure according to a second embodiment.
Figure 4:
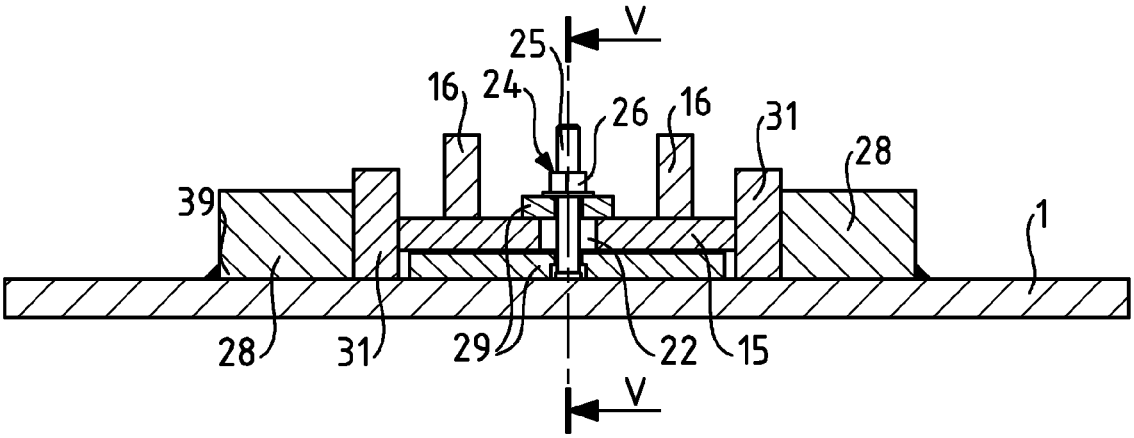
FIG. 4 is sectional view of FIG. 3 along the section plane IV-IV.
Figure 5:
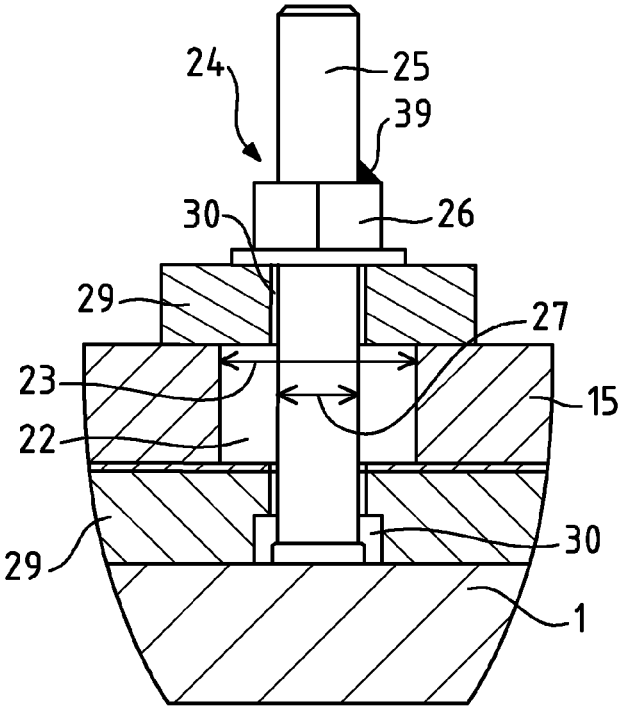
FIG. 5 is a sectional view of FIG. 4 along the section plane V-V.

FIGS. 3 to 5 show a second embodiment of the fixing of a sump structure 9 to a supporting structure 1. This embodiment differs from the first embodiment in terms of the system of locking the fixing lugs 15. Indeed, as can be seen from FIGS. 3 to 5, the fixing lugs 15 of the second embodiment are similar to those of the first embodiment, but in the second embodiment they comprise an orifice 22 with an orifice diameter 23. However, no slide 17 is used to block certain degrees of freedom of the fixing lugs 15 on the supporting structure 1. In place of the slides 17, stops 28 are fixed on the supporting structure 1 near the opening 2. The stops 28 are placed on the supporting structure 1 so as to frame each fixing lug 15 of the sump structure 9 in the tangential direction.

An anchoring device 24 composed of a threaded rod 25, with a threaded rod diameter 27, and a nut 26 is inserted into the orifice 22 of each fixing lug 15 in the direction of thickness. The anchoring device 24 is fixed in the supporting structure 1 by one of its ends, the nut 26 being placed at the other of its ends in such a way as to sandwich the fixing lug 15 with the supporting structure in the direction of thickness. The anchoring device 24 thus blocks the fixing lug 15 in the direction of thickness by clamping against the supporting structure 1. The nut 26 is welded to the threaded rod 25 in the clamping position so as to prevent the nut from coming loose during the use of the storage facility 71.

As can be seen from FIGS. 4 and 5, the orifice 22 is a circular orifice whose diameter 23 is greater than the diameter 27 of the threaded rod 25, so as to leave the fixing lug 15 some clearance in particular in the radial direction so that the sump structure 9 is able to contract or expand. In another embodiment (not shown), the orifice 22 is an oblong orifice whose large dimension is situated in the radial direction.

To ensure that the clamping of the fixing lug 15 by the anchoring device 24 does not adversely affect the potential movement of the sump structure 9 under the effect of thermal contraction, perforated plates 29 comprising a perforation 30 and made of a material having a low coefficient of friction, for example PTFE, are arranged on either side of the fixing lug 15 so as to be interposed between the nut 26 and the supporting structure 1, as can be seen from FIG. 5 in particular. The threaded rod 25 of the anchoring device 24 also passes through the perforations 30 of the perforated plates 29.

By virtue of the low coefficient of friction of the perforated plates 29, the frictional force between the perforated plates and the fixing lug 15 is minimized, allowing the fixing lug 15 and therefore the sump structure to contract or expand in the radial direction.

In order to adjust the distance between the stops 28 and the fixing lug 15 in the tangential direction, shims 31 are interposed between each stop 28 and the fixing lug 15, so as to ensure that the play of the fixing lug 15 in the tangential direction is not too great.

FIGS. 6 to 14 show a plurality of variants for fixing the sump structure 9 to the supporting structure according to a third embodiment. In this embodiment, in contrast to the preceding embodiments, it is no longer a question of leaving the fixing means free in the radial direction but rather of using an elastically deformable fixing means, making it possible, via its deformation, to compensate for the thermal contraction of the sump structure 9.

As is illustrated in FIG. 6, the sump structure 9 is fixed to the supporting structure 1 with the aid of at least one elastically deformable fastener 32. The fastener 32 comprises a first end welded to the supporting structure 1, while a second end, opposite the first end, is welded to the sump structure 9, for example on the side wall 12 of the second container 11 or on the second fixing wing 14.

Figure 7:
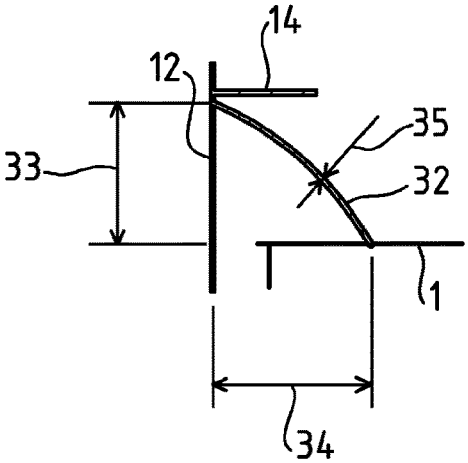
FIG. 7 to FIG. 14 show different embodiments of fixing means designed to fix the sump structure to the supporting structure.

In a normal vector plane in the tangential direction, the cross section of the fastener 32 is defined by its height 33, namely its dimension in the direction of thickness, its wheelbase 34, namely its dimension in the radial direction, and its thickness 35, as can be seen from FIG. 7.

According to several variants, the cross section of the fastener 32 can be of different shapes, thus influencing its stiffness in the radial direction so as to deform more or less easily under the effect of the contraction or expansion of the sump structure 9. In fact, in the embodiment illustrated in FIG. 6, the cross section of the fastener is rectilinear.

FIG. 7 shows a curved fastener section whose curvature is of constant sign, the curvature varying slightly.

Figure 8:
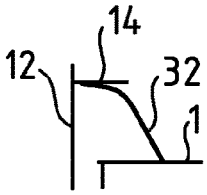

FIG. 8 shows a curved fastener section whose curvature is of constant sign, the curvature varying greatly.

Figure 9:
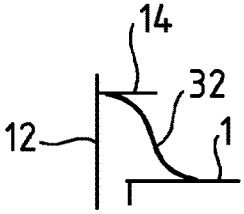

FIG. 9 shows a curved fastener section whose curvature comprises a change of sign, hence a point of inflection, such that the fastener section is slightly undulated.

Figure 10:
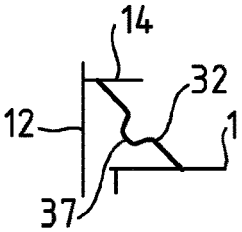

FIG. 10 shows a curved fastener section whose curvature comprises a plurality of changes of signs so as to form an undulation 37.

Figure 11:
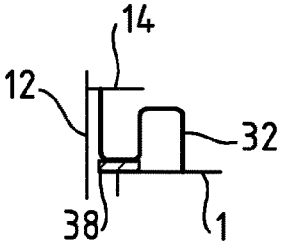

FIG. 11 shows a curved fastener section, the curvature of which comprises a plurality of changes of signs, the curvature varying abruptly at a plurality of points. In addition, the fastener 32 in this variant comprises a bearing point 38 on the supporting structure 1 between the first end and the second end of the fastener 32, so as to reinforce its stiffness in the direction of thickness.

Figure 12:
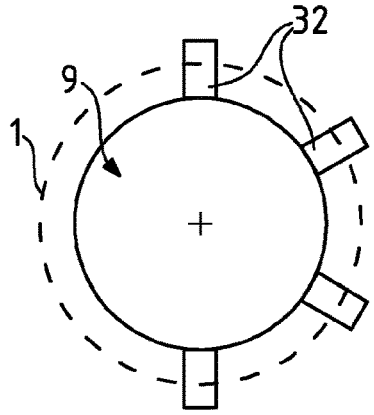

FIG. 12 shows a variant of the third embodiment in which the storage facility 71 comprises a plurality of fasteners 32 distributed regularly or irregularly on the circumference of the second container 11. In this variant, the sump structure 9 is therefore fixed to the supporting structure 1 in a discrete manner by a plurality of fasteners 32.

Figure 13:
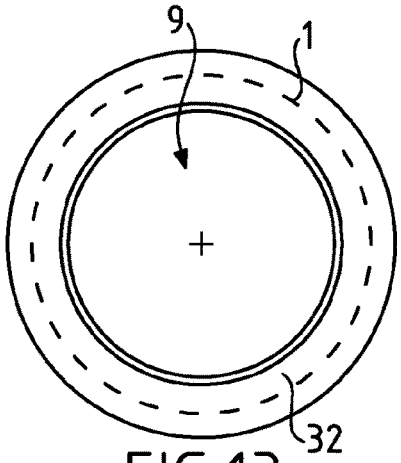

FIG. 13 shows, in contrast to FIG. 12, a variant in which the storage facility 71 comprises a single fastener 32, one edge of which matches the shape of the side wall 12 of the second container 11 and is welded around the entire circumference thereof, while an opposite edge is welded to the supporting structure 1. In this variant, the sump structure 9 is therefore fixed to the supporting structure 1 continuously by a single fastener 32.

Figure 14:
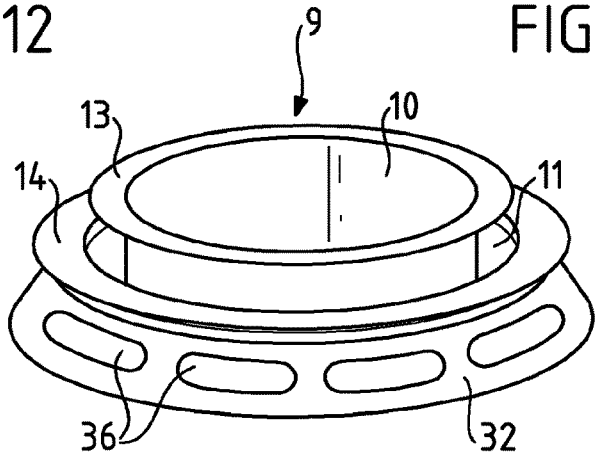

FIG. 14 shows another variant of the third embodiment. In this variant, the fastener 32 is of the same shape as that illustrated in FIG. 12. However, the fastener 32 in FIG. 14 comprises slits 36 distributed periodically over the entire surface of the fastener 32. The slits 36 make it possible in particular to vary the stiffness of the fastener 32 so that the latter can deform elastically under the effect of the contraction or expansion of the sump structure 9. In the embodiment shown, the slits 36 are of oblong shape and are situated between the two edges of the fastener 32. In other variants (not shown), the slits 36 are situated on one or each of the edges of the fastener 32 so as to interrupt the fixing of the fastener 32 periodically or non-periodically. In addition, the slits can be of variable shapes, for example polygonal or circular.

The technique described above for realizing a storage facility can be used in different types of tanks, for example an LNG tank in an onshore facility or in an offshore structure such as an LNG tanker or the like.

Figure 15:
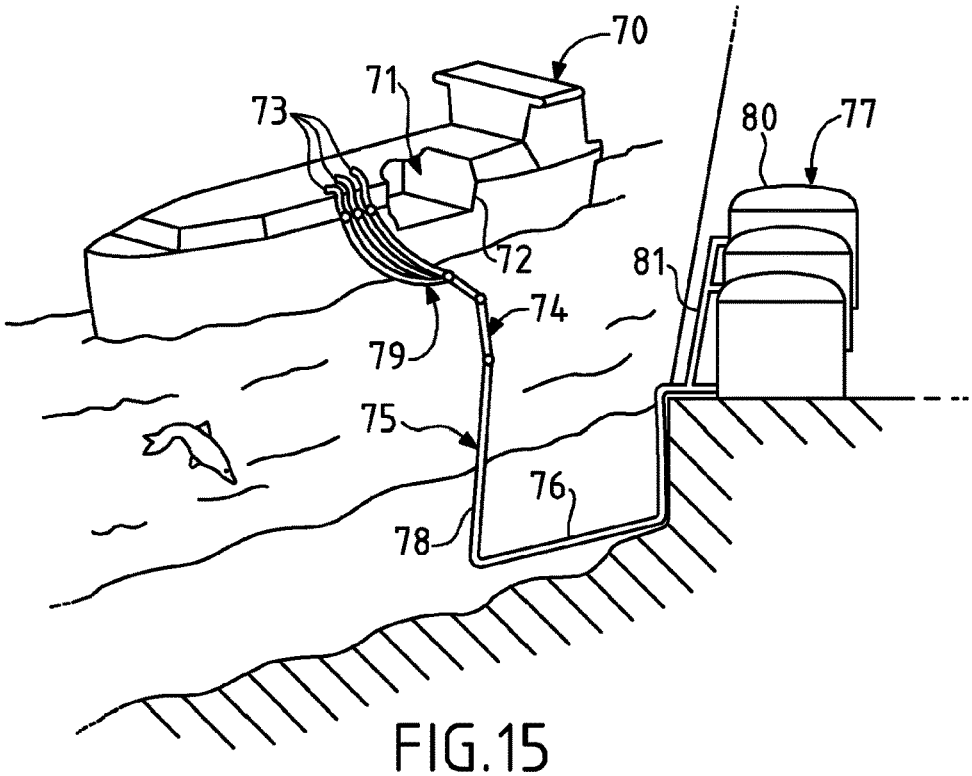
FIG. 15 is a cutaway schematic representation of an LNG tanker, having a storage facility, and of a loading/offloading terminal of this storage facility.

With reference to FIG. 15, a cutaway view of an LNG tanker 70 shows a sealed and insulated tank 71 of generally prismatic shape mounted in the double hull 72 of the ship. The wall of the tank 71 has a primary sealed barrier intended to be in contact with the LNG contained in the tank, a secondary sealed barrier arranged between the primary sealed barrier and the double hull 72 of the ship, and two insulating barriers arranged respectively between the primary sealed barrier and the secondary sealed barrier and between the secondary sealed barrier and the double hull 72.

In a manner known per se, loading/offloading pipes 73 arranged on the upper deck of the ship can be connected, by means of appropriate connectors, to a maritime or harbor terminal for transferring a cargo of LNG from or to the tank 71.

FIG. 15 shows an example of a maritime terminal having a loading and offloading station 75, an underwater line 76 and an onshore facility 77. The loading and offloading station 75 is a fixed offshore facility having a mobile arm 74 and a riser 78 which supports the mobile arm 74. The mobile arm 74 bears a bundle of insulated flexible tubes 79 that can be connected to the loading/offloading pipes 73. The steerable mobile arm 74 adapts to all sizes of LNG tankers. A connecting line (not shown) extends inside the riser 78. The loading and offloading station 75 allows the LNG tanker 70 to be loaded and offloaded from or to the onshore installation 77. The latter has liquefied gas storage tanks 80 and connecting lines 81 linked by the underwater line 76 to the loading or offloading station 75. The underwater line 76 allows the transfer of the liquefied gas between the loading or offloading station 75 and the onshore installation 77 over a great distance, for example 5 km, which makes it possible to keep the LNG tanker 70 at a great distance from the coast during the loading and offloading operations.

To create the pressure necessary for the transfer of the liquefied gas, use is made of pumps on board the ship 70, and/or pumps with which the onshore facility 77 is equipped, and/or pumps with which the loading and offloading station 75 is equipped.

Although the invention has been described in relation to several particular embodiments, it is quite obvious that it is in no way limited thereto and that it encompasses all the technical equivalents of the means described and their combinations, provided that the latter fall within the context of the invention.

The use of the verb "have", "comprise" or "include" and its conjugated forms does not preclude the presence of elements or steps other than those stated in a claim.

In the claims, any reference sign between parentheses should not be interpreted as limiting the claim,

The invention claimed is:

1. A fluid storage facility, the storage facility comprising a supporting structure and a sealed and thermally insulating tank, the tank having at least one bottom wall fixed to the supporting structure, wherein the bottom wall has a structure with multiple layers superimposed in a direction of thickness, including at least one sealing membrane and at least one thermal insulation barrier arranged between the sealing membrane and the supporting structure, wherein the bottom wall has a sump structure locally interrupting the sealing membrane of the bottom wall, the sump structure having a rigid container having a side wall, the container being arranged through the thickness of the bottom wall, and the sump structure comprising at least one fixing lug projecting from the rigid container in a transverse direction perpendicular to the side wall, the at least one fixing lug being designed to fix the rigid container to the supporting structure at a fixing point of the side wall, the at least one fixing lug having an orifice, wherein the facility comprises an anchoring device arranged in the orifice in order to fix the at least one fixing lug to the supporting structure in the direction of thickness, and wherein the at least one fixing lug is configured to allow a relative movement of the side wall of the container with respect to the supporting structure in the transverse direction at the fixing point of the container, the relative movement being greater than 1 mm, and wherein the facility comprises two perforated plates having a perforation, the perforated plates being situated on either side of the at least one fixing lug in the direction of thickness, and the anchoring device passing through the perforation of each perforated plate.

2. The facility as claimed in claim 1, wherein the side wall has a cylindrical shape with the axis oriented in the direction of thickness.

3. The facility as claimed in claim 1, wherein the rigid container has a circular cross section, the transverse direction being a radial direction.

4. The facility as claimed in claim 1, wherein the facility comprises two stops fixed to the supporting structure and situated on either side of the at least one fixing lug in a tangential direction, the tangential direction being tangential to the side wall and orthogonal to the transverse direction and to the direction of thickness, the stops being configured to block the movement of the fixing lug in the tangential direction.

5. The facility as claimed in claim 4, wherein the facility comprises shims arranged between the stops and the fixing lug in the tangential direction, the shims being configured to adjust the distance left free between a stop and a fixing lug in the tangential direction.

6. The facility as claimed in claim 1, wherein the orifice has an oblong orifice whose largest dimension is oriented in the transverse direction, so as to allow the transverse movement of the fixing lug and of the side wall with respect to the anchoring device and to the supporting structure.

7. The facility as claimed in claim 1, wherein the perforated plates are produced from a material whose coefficient of friction is less than 0.2.

8. The facility as claimed in claim 7, wherein the anchoring device has a threaded rod and a nut, the threaded rod being fixed to the supporting structure and passing through the perforations of the perforated plates and the orifice of the fixing lug, the nut being configured to exert a clamping force in the direction of thickness on the perforated plates and the fixing lug with the aid of the supporting structure.

9. The facility as claimed in claim 1, wherein the sump structure comprises at least one reinforcing bracket, a first side of the reinforcing bracket being fixed on the fixing lug, and a second side of the reinforcing bracket, perpendicular to the first side, being fixed to the rigid container.

10. The facility as claimed in claim 1, wherein the sump structure comprises a plurality of fixing lugs distributed regularly on the circumference of the container.

11. A ship for transporting a cold liquid product, the ship having an outer hull and a fluid storage facility as claimed in claim 1 arranged in the outer hull, wherein the supporting structure is an inner hull of the ship.

12. A method of loading or offloading a ship as claimed in claim 11, wherein a cold liquid product is conveyed through insulated pipes from or to an offshore or onshore storage facility to or from the tank of the ship.

13. A transfer system for a cold liquid product, the system comprising a ship as claimed in claim 11, insulated pipes arranged so as to connect the tank, set up in the hull of the ship, to an offshore or onshore storage facility, and a pump for driving a flow of cold liquid product through the insulated pipes from or to the offshore or onshore storage facility to or from the hull of the ship.

14. A fluid storage facility, the storage facility comprising a supporting structure and a sealed and thermally insulating tank, the tank having at least one bottom wall fixed to the supporting structure, wherein the bottom wall has a structure with multiple layers superimposed in a direction of thickness, including at least one sealing membrane and at least one thermal insulation barrier arranged between the sealing membrane and the supporting structure, wherein the bottom wall has a sump structure locally interrupting the sealing membrane of the bottom wall, the sump structure having a rigid container having a side wall, the container being arranged through the thickness of the bottom wall, and the sump structure comprising at least one fixing lug projecting from the rigid container in a transverse direction perpendicular to the side wall, the at least one fixing lug being designed to fix the rigid container to the supporting structure at a fixing point of the side wall, and wherein the facility has at least one slide fixed to the supporting structure and oriented in the transverse direction, the fixing lug being mounted in the slide, and the fixing lug being movable in the slide in the transverse direction in order to obtain a relative movement of the side wall of the container with respect to the supporting structure in the transverse direction at the fixing point of the container, the relative movement being greater than 1 mm.

15. The facility as claimed in claim 14, wherein the slide has a first portion projecting from the supporting structure in the direction of thickness, and a second portion connected to the first portion and oriented in a tangential direction orthogonal to the transverse direction, so as to form a slide with an L-shaped cross section.

16. The facility as claimed in claim 14, wherein the facility has two slides situated on either side of the at least one fixing lug in a tangential direction orthogonal to the transverse direction, the slides being configured to block the movement of the fixing lug in the direction of thickness and in the tangential direction.

17. The facility as claimed in claim 14, wherein the sump structure comprises at least one reinforcing bracket, a first side of the reinforcing bracket being fixed on the fixing lug, and a second side of the reinforcing bracket, perpendicular to the first side, being fixed to the rigid container.

18. The facility as claimed in claim 14, wherein the sump structure comprises a plurality of fixing lugs distributed regularly on the circumference of the container.

19. The facility as claimed in claim 14, wherein the side wall has a cylindrical shape with the axis oriented in the direction of thickness.

20. The facility as claimed in claim 14, wherein the rigid container has a circular cross section, the transverse direction being a radial direction.

21. A ship for transporting a cold liquid product, the ship having an outer hull and a fluid storage facility as claimed in claim 14 arranged in the outer hull, wherein the supporting structure is an inner hull of the ship.

22. A method of loading or offloading a ship as claimed in claim 21, wherein a cold liquid product is conveyed through insulated pipes from or to an offshore or onshore storage facility to or from the tank of the ship.

23. A transfer system for a cold liquid product, the system comprising a ship as claimed in claim 21, insulated pipes arranged so as to connect the tank, set up in the hull of the ship, to an offshore or onshore storage facility, and a pump for driving a flow of cold liquid product through the insulated pipes from or to the offshore or onshore storage facility to or from the hull of the ship.

24. A fluid storage facility, the storage facility comprising a supporting structure and a sealed and thermally insulating tank, the tank having at least one bottom wall fixed to the supporting structure, wherein the bottom wall has a structure with multiple layers superimposed in a direction of thickness, including at least one sealing membrane and at least one thermal insulation barrier arranged between the sealing membrane and the supporting structure, wherein the bottom wall has a sump structure locally interrupting the sealing membrane of the bottom wall, the sump structure having a rigid container having a side wall, the container being arranged through the thickness of the bottom wall, and the sump structure comprising at least one elastically deformable fastener configured to fix the rigid container to the supporting structure, the at least one elastically deformable fastener having a first end welded to the supporting structure and a second end welded to the sump structure, and wherein the at least one elastically deformable fastener is configured to allow a relative movement of the side wall of the container with respect to the supporting structure in a transverse direction perpendicular to the side wall at the fixing point of the container, the relative movement being greater than 1 mm, and wherein the fastener is openworked with slits arranged periodically all around the sump structure.

25. The facility as claimed in claim 24, wherein the fastener is formed continuously all around the sump structure.

26. The facility as claimed in claim 24, wherein the facility comprises a plurality of elastically deformable fasteners distributed regularly all around the sump structure.

27. The facility as claimed in claim 24, wherein the cross section of the fastener, in a normal vector plane oriented in a tangential direction orthogonal to the transverse direction, is rectilinear or curved.

28. A ship for transporting a cold liquid product, the ship having an outer hull and a fluid storage facility as claimed in claim 24 arranged in the outer hull, wherein the supporting structure is an inner hull of the ship.

29. A method of loading or offloading a ship as claimed in claim 28, wherein a cold liquid product is conveyed through insulated pipes from or to an offshore or onshore storage facility to or from the tank of the ship.

30. A transfer system for a cold liquid product, the system comprising a ship as claimed in claim 28, insulated pipes arranged so as to connect the tank, set up in the hull of the ship, to an offshore or onshore storage facility, and a pump for driving a flow of cold liquid product through the insulated pipes from or to the offshore or onshore storage facility to or from the hull of the ship.

31. The facility as claimed in claim 24, wherein the side wall has a cylindrical shape with the axis oriented in the direction of thickness.

32. The facility as claimed in claim 24, wherein the rigid container has a circular cross section, the transverse direction being a radial direction.

* * * * *